US005673278A

United States Patent [19]

Mills et al.

[11] Patent Number: 5,673,278

[45] Date of Patent: Sep. 30, 1997

[54] METHOD AND APPARATUS FOR INTRODUCING DIAGNOSTIC PULSES INTO AN ANALOG SIGNAL GENERATED BY AN INSTRUMENT

[75] Inventors: Jeffrey S. Mills, Carson City; Donald R. Spriggs, Reno, both of Nev.

[73] Assignee: Elsag International N.V., Amsterdam, Netherlands

[21] Appl. No.: 782,528

[22] Filed: Jan. 10, 1997

Related U.S. Application Data

[63] Continuation of Ser. No. 440,385, May 10, 1995.

[51] Int. Cl.[6] ..... G08C 15/08

[52] U.S. Cl. ..... 371/57.2; 371/30; 364/550; 340/870.04

[58] Field of Search ..... 371/57.2, 67.1, 371/25.1, 71, 30; 364/550, 571.01, 571.06; 375/10; 340/870.04, 870.13

[56] References Cited

U.S. PATENT DOCUMENTS

| | | | |
|---|---|---|---|
| 4,549,180 | 10/1985 | Masuda | 340/870.04 |
| 5,051,743 | 9/1991 | Orszulak | 340/870.04 |
| 5,083,288 | 1/1992 | Somlyody et al. | 364/550 |
| 5,289,500 | 2/1994 | Inou et al. | 375/10 |
| 5,420,578 | 5/1995 | O'Brien et al. | 340/870.13 |
| 5,451,923 | 9/1995 | Seberger et al. | 340/310.06 |

*Primary Examiner*—Robert W. Beausoliel, Jr.
*Assistant Examiner*—Nadeem Iqbal
*Attorney, Agent, or Firm*—Michael M. Rickin; Paul R. Katterle

[57] ABSTRACT

A method and apparatus for notifying a receiving device of fault conditions in a sensing element or an instrument. The instrument generates an analog signal that has an amplitude which is representative of a variable. The analog signal amplitude has a range defined by a lower limit and an upper limit. The instrument transmits the analog signal to the receiving device. When the instrument detects a fault condition in itself or in the sensing element, the transmitter periodically changes the analog signal amplitude by a predetermined amplitude for as long as the fault condition exists. The predetermined amplitude and its polarity are such that the amplitude of the periodically changed analog signal lies within the range. The receiving device generates an alarm when it detects the pulses.

22 Claims, 3 Drawing Sheets

METHOD AND APPARATUS FOR INTRODUCING DIAGNOSTIC PULSES INTO AN ANALOG SIGNAL GENERATED BY AN INSTRUMENT

This is a continuation of copending application Ser. No. 08/440,385 filed on May 10, 1995.

FIELD OF THE INVENTION

This invention relates to instruments and more particularly to those instruments that generate analog signals representative of a variable.

DESCRIPTION OF THE PRIOR ART

In the controls industry, analog electrical signals are the most common type of signal used to represent the value of a variable for the purpose of transmitting the value of the variable from one location to another. Within this category of signals, current (as opposed to voltage, phase shift, or frequency) is most commonly used to represent the value of variables. Specifically, the use of a current range of 4–20 mA to represent the range of values for a variable is currently the de facto standard for analog electrical transmission signals in the controls industry. Many instruments described as generating "4–20 mA" signals, however, really generate signals having a slightly greater range such as 3.6 mA to 24 mA. In these instruments, current values of 4 mA and below are considered the lower limit of the range and current values of 20 mA and above are considered the upper limit of the range.

Many instruments generate analog electrical signals representative of the value of a variable. Transmitters and analyzers operating in conjunction with sensing elements generate analog electrical signals representative of the values of physical variables such as flow, temperature, pressure, pH, conductivity, oxidation-reduction potential (ORP), dissolved oxygen, pIon, concentration of gas, level, weight, pressure, differential pressure, humidity and other parameters. Control systems generate analog electrical signals representative of the calculated values of control outputs and other variables. In addition, control systems can generate analog electrical signals by conditioning and re-transmitting analog electrical signals received from transmitters and analyzers. Similarly, instruments normally thought of as receiving devices such as indicators, recorders, positioners and control drives may be capable of generating analog electrical signals by conditioning and re-transmitting analog electrical signals they receive, or by developing their own analog electrical signals representative of the values of feedback variables.

As described above, transmitters and analyzers operate in conjunction with sensing elements to measure and transmit the values of physical variables. Primary sensing elements produce responses to the physical variables such as changing current or voltage levels, displacing armatures, or distorting diaphragms. Secondary sensing elements may also be present and produce further responses. Transducers resident in transmitters and analyzers convert the responses of the sensing elements to analog electrical signals suitable for transmission. Typically, transducers update the analog electrical signals at a rate slower than ten times per second.

Commercially available pressure transmitters (absolute and differential) integrate a transducer with a primary sensing element comprised of a pressure cell. The pressure cell must be in direct contact with the pressure(s) being measured, thereby requiring the pressure transmitter to be located next to the process medium. Transmitters and analyzers for use with primary sensing elements such as conductivity, pH, oxidation-reduction potential (ORP) and specific ion values (collectively, "liquid analysis instruments") and temperature instruments do not integrate a primary sensing element with a transducer. Temperature instruments operate in conjunction with primary sensing elements such as thermocouples and resistance temperature devices (RTDs) that are in direct contact with the process medium. Similarly, liquid analysis instruments operate in conjunction with electrode sensors that are also in direct contact with the process medium.

Primary sensing elements for liquid analysis and temperature instruments generate low level signals that are transmitted through field wiring to their associated instruments. Since the temperature and liquid analysis signals are low level, temperature and liquid analysis instruments are located fairly close to their associated primary sensing elements.

There are also commercially available instruments for nonliquid analysis, for example, weight and density, that operate in conjunction with electrode sensors which are also in direct contact with the process medium. Such instruments also generate low level signals and are also located fairly close to their associated primary sensing elements.

Since primary sensing elements are in contact with the process medium or the process variable, primary sensing elements are typically subjected to harsh operating conditions. The instruments associated with the primary sensing elements are also usually subjected to rigorous operating conditions because the instruments either contain the primary sensing elements or are located proximately to the primary sensing elements. Accordingly, it is necessary to monitor primary sensing elements and instruments for fault conditions, i.e., operating conditions that may adversely affect the quality of the process signal being generated by the instrument. The same also applies to any secondary sensing elements that are included in the instrument.

With the advent of instruments such as "smart" transmitters, it has become possible to monitor transmitters, their associated primary sensing elements and the conditions in which they are operating from a remote location. Smart transmitters can transmit diagnostic and configuration information to a control system and/or field terminal and receive interrogation and configuration information from a control system and/or field terminal. Such information is digitally communicated between the smart transmitter and the control system and/or field terminal over the same two-wire electrical circuit that carries the 4–20 mA process signal. One well known technique for generating this digital communication is frequency shift keying (FSK).

In the FSK method, a high frequency AC signal is superimposed onto the 4–20 mA process signal. The FSK signal has two different frequency levels, one level denoting a binary one and the other level denoting a binary zero. By shifting between the two frequency levels, the FSK method can create digital signals comprised of strings of the two frequency levels representing ones and zeroes. In one derivation of the FSK method used by Fisher-Rosemount, the HART method, the frequency shifting occurs at 1200 Hz bit intervals. In another derivation of the FSK method used by assignee's related entity, Bailey Controls Company ("Bailey"), the frequency shifting occurs at 9600 Hz bit intervals. Regardless of the bit rate used, the FSK method requires that the phase angle of the waveform at the one frequency level and the phase angle of the waveform at the second frequency level remain continuous at the interval boundaries.

Since the average voltage and current of the FSK signal is zero, the DC value of the process signal remains unchanged. In addition, process signal receiving circuits in control systems, indicators and recorders typically scan inputs at a rate equal to or faster than the update time of a 4–20 mA transmitter signal, but slower than the period of an FSK signal. Process signal receiving circuits filter out fluctuations in the current occurring at high frequencies such as 1200 Hz. Thus, process signal receiving circuits do not detect the FSK signal. Only FSK receiving circuits can detect an FSK signal. Typically, recorders and indicators do not contain FSK receiving circuits. Primarily, only control systems and field terminal devices have FSK receiving circuits. In addition, FSK receiving circuits are specific to a certain type of FSK method, i.e., FSK signals generated using the HART method can only be detected by a HART receiving circuit.

For the foregoing reasons, it is desirable to have a method and apparatus for transmitting both a process signal and a diagnostic signal from an instrument to a receiving device that is only capable of detecting a standard analog electrical process signal from the instrument. The method and apparatus of the present invention meets this requirement.

SUMMARY OF THE INVENTION

An instrument which has means for generating an analog signal having an amplitude representative of the value of a variable. The analog signal amplitude has a predetermined range defined by a lower limit and an upper limit. The instrument also has means for detecting a fault condition in the instrument. The instrument further has means for periodically changing the analog signal amplitude by a predetermined amplitude for as long as the fault condition exists. The predetermined amplitude is such that the periodically changed analog signal amplitude lies within the predetermined range.

An instrument for use with a sensing element that generates a low-level process signal representative of the value of a physical variable of a process medium. The instrument has means for generating an analog signal from the low-level process signal. The analog signal has an amplitude representative of the value of the physical variable. The analog signal amplitude has a predetermined range defined by a lower limit and an upper limit. The instrument also has means for detecting a fault condition in the sensing element. The instrument further has means for periodically changing the analog signal amplitude by a predetermined amplitude for as long as the fault condition exists. The predetermined amplitude is such that the periodically changed analog signal amplitude lies within the predetermined range.

In an instrument circuit having an instrument operating in conjunction with a receiving device and a sensing element that generates a low-level process signal representative of the value of a physical variable of a process medium, a method for notifying the receiving device of a fault condition in the sensing element using an analog signal generated by the instrument from the low-level process signal. The analog signal has an amplitude representative of the value of the physical variable. The analog signal amplitude has a predetermined range defined by a lower limit and an upper limit. The method has the following steps:

(a) detecting a fault condition in the instrument circuit;

(b) periodically changing the analog signal amplitude by a predetermined amplitude for as long as the fault condition exists. The predetermined amplitude is such that the periodically changed analog signal amplitude lies within the predetermined range; and (c) providing an indication of the predetermined amplitude occurring in the periodically changed analog signal amplitude at the receiving device.

An instrument circuit which has a receiving device; a sensing element that generates a low-level process signal representative of the value of a physical variable of a process medium; and an instrument operating in conjunction with the receiving device and the sensing element.

The instrument has means for generating an analog signal from the low-level process signal. The analog signal has an amplitude representative of the value of the physical variable. The analog signal amplitude has a predetermined range defined by a lower limit and an upper limit. The instrument also has means for detecting a fault condition in the sensing element. The instrument further has means for periodically changing the analog signal amplitude by a predetermined amplitude for as long as the fault condition exists. The predetermined amplitude is such that the periodically changed analog signal amplitude lies within the predetermined range. The instrument also further has means for transmitting the analog signal to the receiving device. The receiving device has means for providing an indication of the predetermined amplitude occurring in the periodically changed analog signal amplitude.

DESCRIPTION OF THE DRAWINGS

The features, aspects, and advantages of the present invention will become better understood with regard to the following description, appended claims, and accompanying drawings where:

DESCRIPTION OF THE PREFERRED EMBODIMENT(S)

Figure 1:
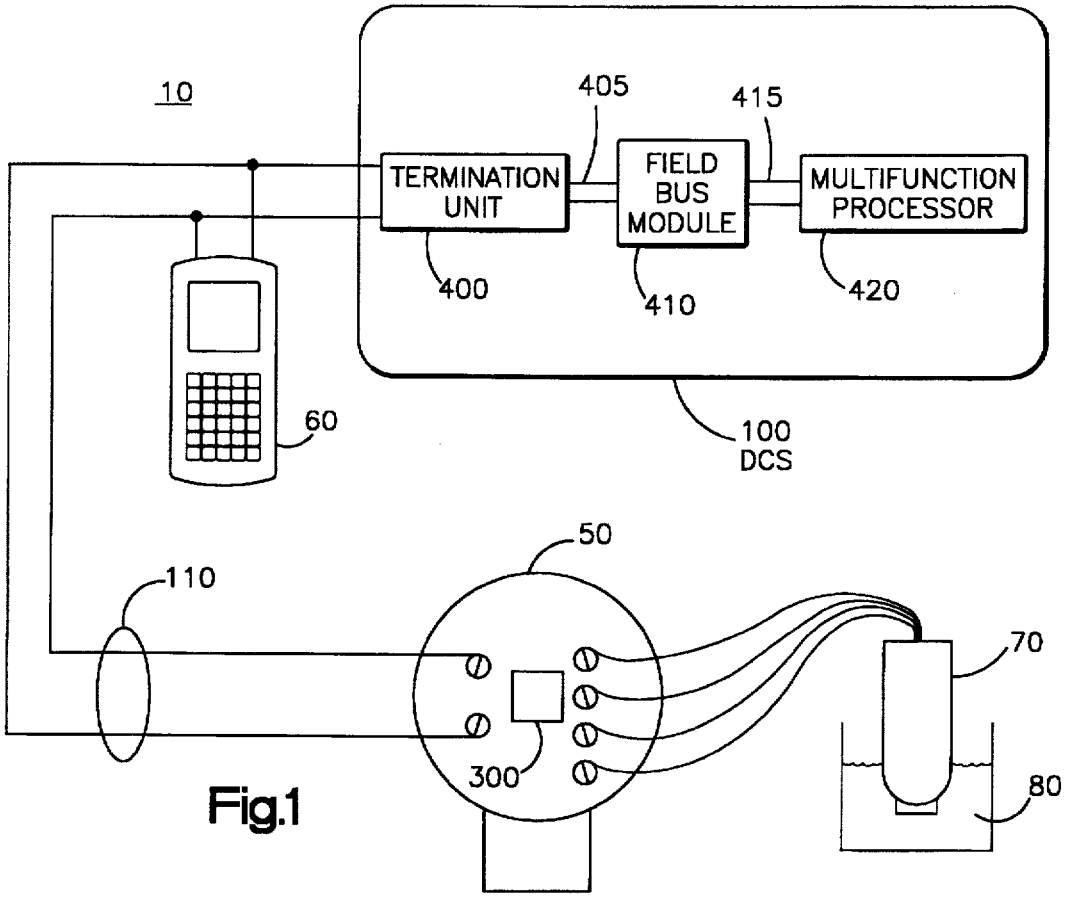
FIG. 1 shows a representative drawing of an instrument circuit containing a conductivity transmitter having a diagnostic pulse feature embodied in accordance with the present invention.

Referring now to FIG. 1, there is shown a representative drawing of an instrument circuit 10 containing a conductivity transmitter 50 having a diagnostic pulse feature embodied in accordance with the present invention. The instrument circuit 10 is comprised of the conductivity transmitter 50, a smart terminal 60, a conductivity sensor 70 in contact with a process medium 80, and a distributed control system (DCS) 100 configured to receive standard 4–20 mA process signals. The DCS 100 is connected to the output of the conductivity transmitter 50 by a two-wire circuit 110.

Conductivity transmitter 50 in combination with conductivity sensor 70 measures the conductivity of the process medium 80. The resistance of the process medium 80 to the flow of AC current provides a measure of the conductivity of the process medium 80. The transmitter 50 includes circuitry (not shown) for determining when the sensor 70 becomes fouled. Sensor fouling occurs when an excessive layer of solutes is deposited on the sensor electrodes that are in contact with the process medium 80. Transmitter 50 includes a microcomputer 300.

Conductivity sensor 70 includes a thermocouple (not shown). The microcomputer 300 in the conductivity transmitter 50 receives a digital signal representative of the raw conductivity of the process medium 80 and a digital signal representative of the temperature of the medium. The microcomputer 300 uses these two signals to calculate a signal that is representative of the conductivity of process medium 80 at a reference temperature of 25° Celsius. The digital conductivity signal is converted into a pulse width modulation conductivity signal. One example of conductivity transmitter 50 is the Model TBN480 transmitter sold by the TBI operating unit of Bailey. One example of conductivity sensor 70 is the Model TB461 sensor also sold by TBI.

Figure 2:
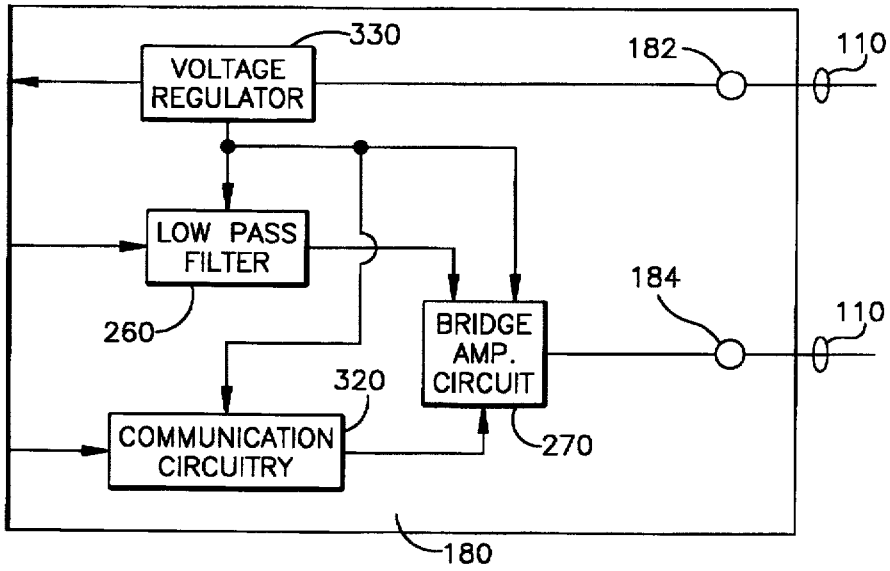
FIG. 2 shows a simplified block diagram for an output board in the conductivity transmitter having the diagnostic pulse feature embodied in accordance with the present invention.

Referring now to FIG. 2, there is shown a simplified block diagram for the output board 180 located in conductivity transmitter 50. The output board 180 receives the pulse width modulation signal from the microcomputer 300 The output board 180 is connected to the two-wire circuit 110 at terminals (182, 184). Terminal 182 is connected to a voltage regulator 330 and terminal 184 is connected to a bridge amplifier circuit 270. The DCS 100 (shown in FIG. 1) produces a potential difference of 24 VDC across the two-wire circuit 110, providing power to the conductivity transmitter 50 through the voltage regulator 330.

In the output board 180, the "pulse width modulation" conductivity signal is converted to a DC level conductivity signal in a low pass filter 260. The DC level conductivity signal is fed into the bridge amplifier circuit 270 which drives the current level in the two-wire circuit 110 between 4 mA and 20 mA, thereby producing a 4–20 mA process signal representative of the conductivity of the process medium 80. The 4–20 mA process signal is updated once every second and is received and processed by the DCS 100.

In lieu of generating the 4–20 mA process signal, the conductivity transmitter 50 can generate a digital signal representative of the conductivity of the process medium 80. In the digital mode, the microcomputer 300 sets the current level in the two-wire circuit 110 to 6 mA for low power consumption. Using FSK, communication circuitry 320 in the output board 180 converts the "pulse width modulation" conductivity signal into a digital process signal that is superimposed on the 6 mA signal and transmitted to the DCS 100 (shown in FIG. 1) over the two-wire circuit 110.

The conductivity transmitter 50 will be in an analog mode and will generate the 4–20 mA process signal unless the conductivity transmitter 50 is given an address when an operator configures the conductivity transmitter 50. The conductivity transmitter 50 is configured from the smart terminal 60 (shown in FIG. 1). The smart terminal 60 communicates with the conductivity transmitter 50 using FSK. In addition to permitting the operator to configure the conductivity transmitter 50, the smart terminal 60 permits an operator to calibrate the conductivity transmitter 50, perform diagnostic checks on the conductivity transmitter 50, monitor the conductivity sensor 70 and monitor the process signal from the conductivity transmitter 50, all from a local or remote location. One example of such a smart terminal is Smart Transmitter Terminal Type STT02E sold by Bailey.

If the operator gives the conductivity transmitter 50 an address within a range of 1 to 15 while configuring the conductivity transmitter 50, the conductivity transmitter 50 will place itself into a digital mode and will generate the digital process signal. If, however, the operator does not give the conductivity transmitter 50 an address, thereby programming the conductivity transmitter 50 for the analog mode, the smart terminal 60 will query the operator whether the operator wants to enable the diagnostic pulse feature in the conductivity transmitter 50. If the operator answers in the affirmative, the operator must then enter (in the form of a percentage of the 4–20 mA process signal) the magnitude of the pulse to be generated.

When the diagnostic pulse feature is enabled and when a fault condition in the conductivity sensor 70 is detected, the diagnostic pulse feature will introduce a train of pulses into the 4–20 mA process signal until the fault condition disappears. The duration of each pulse is 1.67 seconds and the time between pulses is 8.33 seconds. If the measurement value is below 12 milliamps, the pulses are positive, i.e., the amplitude for each pulse is added to the measurement value; however the sum of the amplitude and the measurement value is limited to 20 mA. If, however, the measurement value is above 12 milliamps, the pulses are negative, i.e., the amplitude for each pulse is subtracted from the measurement value; however the difference between the measurement value and the pulse amplitude is limited to a minimum of 4 mA. The amplitude of the pulses is equal to the pulse magnitude entered by the operator during configuration (in decimal form) multiplied by 16 mA. A pulse magnitude of ten percent will cause the amplitude for the pulses to be 1.6 milliamps (0.10 times 16 milliamps), whereas a pulse magnitude of twenty-five percent will cause the amplitude for the pulses to be 4 milliamps (0.25 times 16 milliamps).

Figure 3:
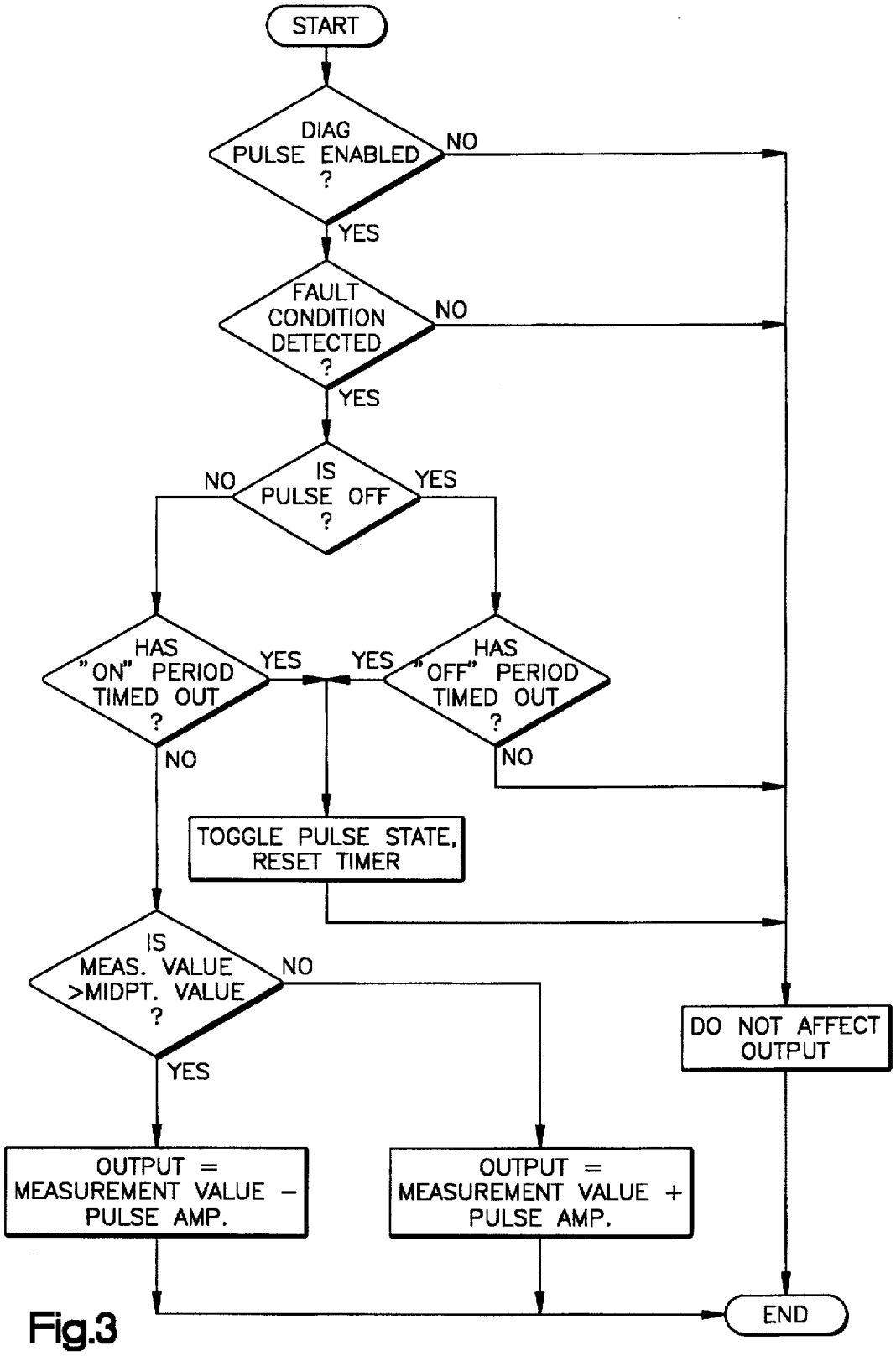
FIG. 3 shows a flow diagram of a set of instructions contained in the Read Only Memory of a microcomputer that implements the diagnostic pulse feature embodied in accordance with the present invention.

Referring now to FIG. 3, there is shown a flow diagram of a set of instructions 350 contained in the Read Only Memory (ROM) of the microcomputer (not shown) inside the conductivity transmitter 50 (shown in FIG. 1) that implements the diagnostic pulse feature embodied in accordance with the present invention. The set of instructions 350 are executed during each cycle of the microcomputer. The set of instructions 350 first determines whether the diagnostic pulse feature has been enabled. If so, the set of instructions 350 then determines if a fault condition has been detected by a second set of instructions (not shown) in the ROM of the microcomputer. The second set of instructions determines that a fault condition is present if the conductivity sensor 70 is excessively fouled, or if the temperature of the process medium 80 is above 200 degrees Centigrade or below −20 degrees Centigrade, or if the conductivity sensor 70 is over or under range (such as might exist in a shorted or open input situation).

If the set of instructions 350 determines that the second set of instructions has detected a fault condition, the set of instructions 350 will then determine whether the pulse is on or off and whether a timer (not shown) in the microcomputer has timed out for the "on period" or the "off period" depending on the state the pulse is in. If the pulse is on and the "on period" has not timed out, the set of instructions 350 will: (i) add the pulse amplitude to the measurement value if the measurement value is less than the midpoint value (12 mA) within the measurement range (4–20 mA), or (ii) subtract the pulse amplitude from the measurement value if the measurement value is greater than the midpoint value within the measurement range. If the pulse is on and the timer has timed out for the "on period", the set of instructions 350 resets the timer and toggles the 4–20 mA process signal back to its measurement value. If the pulse is off and the "off period" has not timed out, the set of instructions 350 keeps the 4–20 mA process signal at its measurement value. If, however, the pulse is off and the "off period" has timed out, the set of instructions 350 resets the timer and toggles the 4–20 mA process signal to the measurement value plus or minus the pulse amplitude (depending on where the measurement value is).

The pulse period is ten (10) seconds long and is comprised of the "on period" and the "off period". The "on period" is set for ⅙ of the pulse period (1.67 seconds) while the "off period" is set for ⅚ of the pulse period (8.33 seconds). Although the durations of the pulse period, the "on period" and the "off period" are set values, it should be appreciated that the durations of these periods can be made user definable in a manner similar to the pulse magnitude.

Figure 5:
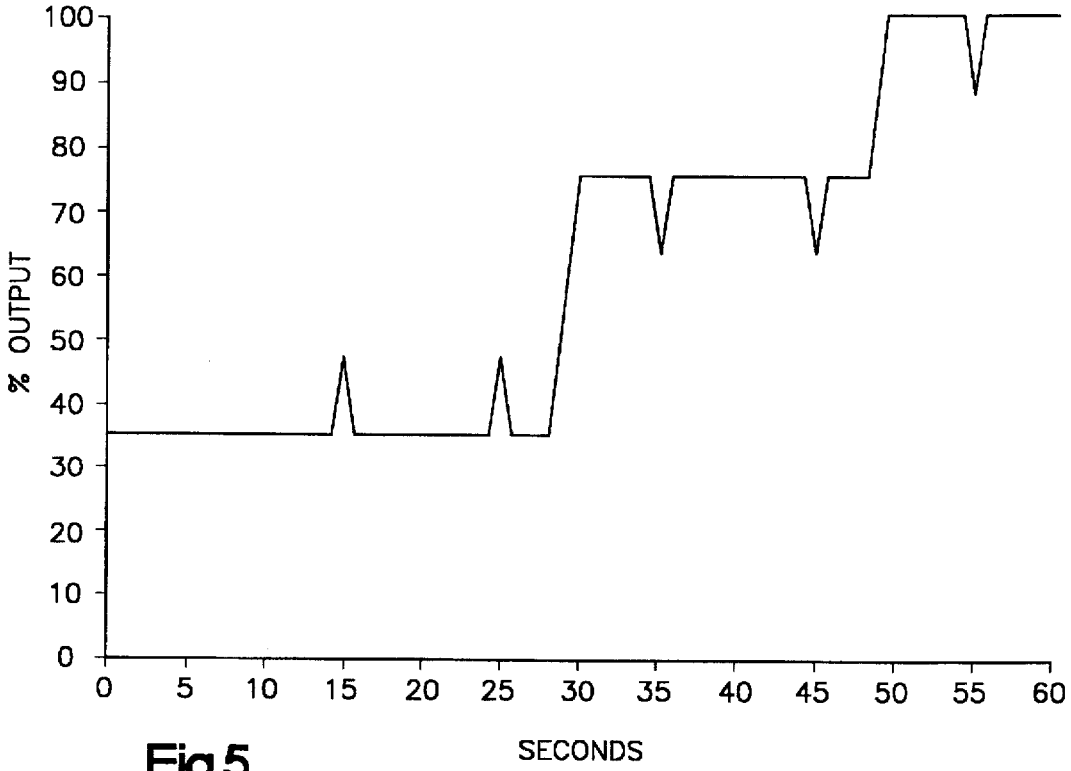
FIG. 5 shows an example of the waveform of the process signal including the fault diagnostic pulses of the present invention.

Referring now to FIG. 5, there is shown an example of the waveform of the 4–20 mA process signal which includes the fault notification pulses of the present invention. From time zero to 14 seconds in this example the output of the instrument is at 9.6 mA, that is, at 35% of full scale and no fault exists. At a time between 14 and 15 seconds a fault is detected and a pulse having a duration of about one to two seconds and an amplitude of about 1.6 mA, that is 10% of the difference between 20 mA and 4 mA, is initiated in the 4–20 mA signal. The amplitude of the pulse is added to the amplitude of the 4–20 mA signal as the measurement value of the process variable is less than 12 mA, that is, less than 50% of full scale. Since the fault condition continues to exist at a time between 24 and 25 seconds, another pulse of about one to two seconds duration and having an amplitude of about 1.6 mA is also added to the amplitude of the 4–20 mA signal at that time.

At 28 seconds the measured process variable starts to increase towards 75% of full scale and the output of the instrument shows this increase. At 30 seconds the measured process variable stabilizes at 16 mA, that is, at 75% of full scale, as does the instrument output. Since the fault condition continues to exist at a time between 34 and 35 seconds, the next pulse of about one to two seconds duration and 1.6 mA amplitude is initiated in the 4–20 mA at that time. The amplitude of this pulse is, however, subtracted from the amplitude of the 4–20 mA signal as the measurement value of the process variable is above 50% of full scale. Since the fault condition continues to exist at a time between 44 and 45 seconds, another such pulse occurs at that time and its amplitude is also subtracted from the amplitude of the 4–20 mA signal.

At 48 seconds the measured process variable starts to increase towards 100% of full scale and the output of the instrument shows this increase. At 50 seconds the measured process variable stabilizes at 20 mA, that is, at 100% of full scale, as does the instrument output. Since the fault condition continues to exist at a time between 54 and 55 seconds, the next pulse of about one to two seconds duration and 1.6 mA amplitude is initiated in the 4–20 mA at that time. The amplitude of this pulse is, however, subtracted from the amplitude of the 4–20 mA signal as the measurement value of the process variable is above 50% of full scale. It should be appreciated that if the amplitude of the pulse were added to the measurement value of the process variable at 55 seconds, the combined amplitude would be above the 20 mA upper limit of the 4–20 mA range of output amplitude of the instrument.

It should be appreciated that the diagnostic pulse feature could be modified to also introduce a train of pulses into the 4–20 mA process signal if a fault condition in the conductivity transmitter 50 (shown in FIG. 1) itself is detected. The conductivity transmitter 50 contains internal diagnostic circuitry (not shown) that monitors the internal reference voltages, configurations and input circuitry of the conductivity transmitter 50.

Referring back to FIG. 1, the 4–20 mA process signal (including any pulse train introduced by the diagnostic pulse feature) is transmitted to the DCS 100 over the two-wire circuit 110. The 4–20 mA process signal is received by a termination unit 400, converted to an analog 1–5 volt signal and then transmitted to a field bus module 410 over TU wiring 405. A dual slope analog-to-digital converter (not shown) in the field bus module 410 converts the analog 1–5 volt signal to a digital DCS signal. Since the analog to digital conversion of the analog 1–5 volt takes place at a rate of once every 100 milliseconds, any pulse trains that are introduced by the diagnostic pulse feature will appear in the DCS signal.

The DCS signal is transmitted to a multifunction processor 420 over a module bus 415. In the multifunction processor 420, the DCS signal is input into an alarm/filter configuration comprised of interconnected function code blocks. Function code blocks are algorithms resident in the read only firmware (not shown) of the multifunction processor 420. One example of such a multifunction processor having function codes is the MFP01 sold by Bailey.

While FIG. 1 has shown a DCS 100 as receiving the 4–20 mA process signals which may include the diagnostic pulses of the present invention it is not required that the instrument circuit include a DCS. The instrument circuit may, for example, include a chart recorder that receives the 4–20 mA process signals and prints a graphical representation thereof. Therefore, the chart recorder will also receive the diagnostic pulses and print a graphical representation thereof. Upon viewing the output of the chart recorder, the operator will see the diagnostic pulses and thereby become aware that a fault condition has occurred in the instrument. One example of such a chart recorder is the Series 1200 Chart Recorder sold by Linear.

Figure 4:
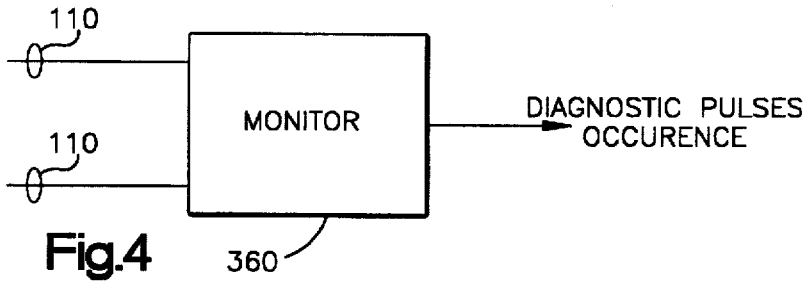
FIG. 4 shows a diagram of a configuration resident in a multifunction processor for generating an alarm from the pulses generated by the diagnostic pulse feature embodied in accordance with the present invention.

Alternatively the instrument circuit may, for example, include a device 360, as is shown in block diagram form in FIG. 4, that is connected to two-wire circuit 110. The device 360 thus receives the 4–20 mA process signal. The device may be of the type that monitors the process signal to determine the occurrence of the diagnostic pulses and provides an output signal once the device has determined that the received pulses are valid that is indicative of the occurrence of the diagnostic pulses. One example of such a device is the RTI-820 I/O Interface Board sold by Analog Devices in conjunction with a software package such as Labtech Notebook sold by Laboratories Technologies Corporation. The output signal may be used by further devices (not shown in FIG. 4) to provide an alarm. The alarm may be audible or visible or if the further device is a DCS may appear on an operator's console. Those skilled in the art will appreciate that if the further device is a DCS, the DCS may be designed so that upon occurrence of the output signal the DCS queries the instrument in order to determine the type of fault condition.

It is to be understood that the description of the preferred embodiment(s) is (are) intended to be only illustrative, rather than exhaustive, of the present invention. The diagnostic pulse feature can be implemented in pH, ORP and specific ion transmitters as well as in pressure, flow, temperature and other transmitters. Those of ordinary skill will be able to make certain additions, deletions, and/or modifications to the embodiment(s) of the disclosed subject matter without departing from the spirit of the invention or its scope, as defined by the appended claims.

What is claimed is:

1. An instrument comprising:

(a) means for generating an analog signal having an amplitude representative of the value of a variable, said analog signal amplitude having a predetermined range defined by a lower limit and an upper limit;

(b) means for detecting a fault condition in said instrument; and (c) means for periodically changing said analog signal amplitude by a predetermined amplitude for as long as said fault condition exists, said predetermined amplitude such that said periodically changed analog signal amplitude lies within said predetermined range.

2. The instrument of claim 1 wherein said predetermined amplitude is positive if said analog signal amplitude is in the bottom half of said predetermined range and wherein said predetermined amplitude is negative if said analog signal amplitude is in the top half of said predetermined range.

3. The instrument of claim 2 further comprising a means for selecting said predetermined amplitude so that said predetermined amplitude does not exceed the difference between said upper limit of said analog signal amplitude and said lower limit of said analog signal amplitude.

4. The instrument of claim 3 wherein if said predetermined amplitude is positive, said predetermined amplitude is equal to the lesser of said predetermined amplitude and an addition amount equal to said upper limit minus said analog signal amplitude, and wherein if said predetermined amplitude is negative, said predetermined amplitude is equal to the lesser of said predetermined amplitude and a subtraction amount equal to said analog signal amplitude minus said lower limit.

5. The instrument of claim 4 wherein said upper limit of said analog signal amplitude is 20 milliamps and said lower limit of said analog signal amplitude is 4 milliamps.

6. The instrument of claim 1 wherein a sensing element is provided for generating a low-level process signal representative of said variable and wherein said generating means generates said analog signal amplitude from said low-level process signal.

7. The instrument of claim 6 wherein said variable is a physical variable of a process medium.

8. An instrument for use with a sensing element that generates a low-level process signal representative of the value of a physical variable of a process medium, said instrument comprising:

(a) means for generating an analog signal from said low-level process signal, said analog signal having an amplitude representative of the value of said physical variable, said analog signal amplitude having a predetermined range defined by a lower limit and an upper limit;

(b) means for detecting a fault condition in said sensing element; and (c) means for periodically changing said analog signal amplitude by a predetermined amplitude for as long as said fault condition exists, said predetermined amplitude such that said periodically changed analog signal amplitude lies within said predetermined range.

9. The instrument of claim 8 wherein said predetermined amplitude is positive if said analog signal amplitude is in the bottom half of said predetermined range and wherein said predetermined amplitude is negative if said analog signal amplitude is in the top half of said predetermined range.

10. The instrument of claim 9 further comprising a means for selecting said predetermined amplitude so that said predetermined amplitude does not exceed the difference between said upper limit of said analog signal amplitude and said lower limit of said analog signal amplitude.

11. The instrument of claim 10 wherein if said predetermined amplitude is positive, said predetermined amplitude is equal to the lesser of said predetermined amplitude and an addition amount equal to said upper limit minus said analog signal amplitude, and wherein if said predetermined amplitude is negative, said predetermined amplitude is equal to the lesser of said predetermined amplitude and a subtraction amount equal to said analog signal amplitude minus said lower limit.

12. The instrument of claim 11 wherein said upper limit of said analog signal amplitude is 20 milliamps and said lower limit of said analog signal amplitude is 4 milliamps.

13. The instrument of claim 12 wherein said sensing element also generates a low-level temperature signal representative of the temperature of said process medium and wherein said generating means uses said low-level temperature signal to generate said analog signal amplitude.

14. The instrument of claim 13 wherein said fault condition is said low-level temperature signal being outside a predetermined temperature signal range.

15. The instrument of claim 13 wherein said fault condition is said low-level process signal being outside a predetermined process signal range.

16. The instrument of claim 13 wherein said fault condition is excessive fouling of said primary sensing element.

17. In an instrument circuit having an instrument operating in conjunction with a receiving device and a sensing element that generates a low-level process signal representative of the value of a physical variable of a process medium, a method for notifying said receiving device of a fault condition in said sensing element using an analog signal generated by said instrument from said low-level process signal, said analog signal having an amplitude representative of the value of said physical variable, said analog signal amplitude having a predetermined range defined by a lower limit and an upper limit, said method comprising the steps of:

(a) detecting a fault condition in said instrument circuit;

(b) periodically changing said analog signal amplitude by a predetermined amplitude for as long as said fault condition exists, said predetermined amplitude such that said periodically changed analog signal amplitude lies within said predetermined range; and (c) providing an indication of said predetermined amplitude occurring in said periodically changed analog signal amplitude at said receiving device.

18. The method of claim 17 wherein said predetermined amplitude is positive if said analog signal amplitude is in the bottom half of said predetermined range and wherein said predetermined amplitude is negative if said analog signal amplitude is in the top half of said predetermined range.

19. The method of claim 17 wherein said step of providing an indication in said receiving device of said predetermined amplitude comprises the steps of:

(i) detecting said predetermined amplitude in said receiving device; and (ii) generating an alarm in said receiving device when said predetermined amplitude is detected in said receiving device.

20. An instrument circuit comprising:

(a) a receiving device;

(b) a sensing element that generates a low-level process signal representative of the value of a physical variable of a process medium; and (c) an instrument operating in conjunction with said receiving device and said sensing element, said instrument comprising:

(i) means for generating an analog signal from said low-level process signal, said analog signal having an amplitude representative of the value of said physical variable, said analog signal amplitude having a predetermined range defined by a lower limit and an upper limit;

(ii) means for detecting a fault condition in said sensing element;

(iii) means for periodically changing said analog signal amplitude by a predetermined amplitude for as long as said fault condition exists, said predetermined amplitude such that said periodically changed analog signal amplitude lies within said predetermined range; and (iv) means for transmitting said analog signal to said receiving device;

said receiving device comprising means for providing an indication of said predetermined amplitude occurring in said periodically changed analog signal amplitude.

21. The instrument circuit of claim 20 wherein said predetermined amplitude is positive if said analog signal amplitude is in the bottom half of said predetermined range and wherein said predetermined amplitude is negative if said analog signal amplitude is in the top half of said predetermined range.

22. The instrument circuit of claim 20 wherein said receiving device means for providing an indication further comprises:

(i) means for detecting said predetermined amplitude; and (ii) means for generating an alarm when said predetermined amplitude is detected.

* * * * *